US012557914B2

(12) United States Patent
Youngblood et al.

(10) Patent No.: US 12,557,914 B2
(45) Date of Patent: Feb. 24, 2026

(54) ARTICLE COMPRISING A TEMPERATURE-CONDITIONED SURFACE, THERMOELECTRIC CONTROL UNIT, AND METHOD FOR TEMPERATURE-CONDITIONING THE SURFACE OF AN ARTICLE

(71) Applicant: SLEEP SOLUTIONS INC., Wilmington, DE (US)

(72) Inventors: Todd Youngblood, Mooresville, NC (US); Tara Youngblood, Mooresville, NC (US)

(73) Assignee: SLEEP SOLUTIONS INC., Wilmington, DE (US)

( * ) Notice: Subject to any disclaimer, the term of this patent is extended or adjusted under 35 U.S.C. 154(b) by 18 days.

(21) Appl. No.: 17/238,976

(22) Filed: Apr. 23, 2021

(65) Prior Publication Data

US 2021/0235880 A1 Aug. 5, 2021

Related U.S. Application Data

(63) Continuation of application No. 16/383,092, filed on Apr. 12, 2019, now Pat. No. 11,013,339, which is a (Continued)

(51) Int. Cl.
*F25B 21/02* (2006.01)
*A47C 7/74* (2006.01)

(Continued)

(52) U.S. Cl.
CPC ..... *A47C 21/044* (2013.01); *A47C 7/744* (2013.01); *A47C 31/105* (2013.01); *A47C 31/11* (2013.01);

(Continued)

(58) Field of Classification Search
CPC ..... A47C 7/744; A47C 21/044; A47C 31/105; A47C 31/11; F25B 21/02; F25B 21/04; F25D 17/02; F25D 29/00
See application file for complete search history.

(56) References Cited

U.S. PATENT DOCUMENTS 2,753,435 A 7/1956 Ivar
4,132,262 A 1/1979 Wibell (Continued)

FOREIGN PATENT DOCUMENTS

KR 20060019762 A 3/2006
KR 20110102637 A 9/2011
WO 2014145436 A1 9/2014

OTHER PUBLICATIONS

Buysse, D.J., Reynolds, C.F., Monk, T.H., Berman, S.R., & Kupfer, D.J. (1989). The Pittsburgh Sleep Quality Index (PSQI): A new instrument for psychiatric research and practice. Psychiatry Research, 28(2), 193-213.

(Continued)

*Primary Examiner* — Nael N Babaa
(74) *Attorney, Agent, or Firm* — Cozen O'Connor

(57) ABSTRACT

A thermoelectric control unit is adapted for regulating liquid temperature in a hydraulic circuit. The control unit comprises a housing, and a liquid reservoir for containing a liquid inside the housing. The reservoir has a fill opening, a liquid outlet, and a liquid return. A conduit assembly extends from the liquid outlet to the liquid return. A pump is operatively connected to the reservoir, and is adapted for moving the liquid through the conduit assembly within the hydraulic circuit. A first heat exchanger communicates with the liquid reservoir. A second heat exchanger resides adjacent the first heat exchanger, and communicates with an environment outside of the liquid reservoir and inside of the (Continued)

housing. A substantially planar thermoelectric cooling module is located at an electrified junction between the first and second heat exchangers.

18 Claims, 4 Drawing Sheets

Related U.S. Application Data continuation of application No. 14/777,050, filed as application No. PCT/US2014/030202 on Mar. 17, 2014, now Pat. No. 10,278,511.

(60) Provisional application No. 61/800,768, filed on Mar. 15, 2013.

(51) Int. Cl.

| | |
|---|---|
| ***A47C 21/04*** | (2006.01) |
| ***A47C 31/10*** | (2006.01) |
| ***A47C 31/11*** | (2006.01) |
| ***F25B 21/04*** | (2006.01) |
| ***F25D 17/02*** | (2006.01) |
| ***F25D 29/00*** | (2006.01) |

(52) U.S. Cl.

CPC ..... *F25B 21/02* (2013.01); *F25B 21/04* (2013.01); *F25D 17/02* (2013.01); *F25D 29/00* (2013.01)

(56) References Cited

U.S. PATENT DOCUMENTS

| | | | |
|---|---|---|---|
| 4,459,468 | A | 7/1984 | Bailey |
| 4,777,802 | A | 10/1988 | Feher |
| 4,858,609 | A | 8/1989 | Cole |
| 5,033,136 | A | 7/1991 | Elkins |
| 5,304,112 | A | 4/1994 | Mrklas et al. |
| 5,329,096 | A | 7/1994 | Suematsu |
| 5,448,788 | A | 9/1995 | Wu |
| 5,894,615 | A | 4/1999 | Alexander |
| 5,948,303 | A | 9/1999 | Larson |
| 6,163,907 | A | 12/2000 | Larson |
| 6,273,810 | B1 | 8/2001 | Rhodes, Jr. et al. |
| 6,371,976 | B1 | 4/2002 | Vrzalik et al. |
| 6,484,062 | B1 | 11/2002 | Kim |
| 6,581,224 | B2 | 6/2003 | Yoon |
| 6,826,792 | B2 | 12/2004 | Lin |
| 7,041,049 | B1 | 5/2006 | Raniere |
| 7,238,289 | B2 | 7/2007 | Suddath |
| 7,248,915 | B2 | 7/2007 | Rönnholm |
| 7,306,567 | B2 | 12/2007 | Loree |
| 7,460,899 | B2 | 12/2008 | Almen |
| 7,524,279 | B2 | 4/2009 | Auphan |
| 7,608,041 | B2 | 10/2009 | Sutton |
| 7,699,785 | B2 | 4/2010 | Nemoto |
| 7,868,757 | B2 | 1/2011 | Radivojevic et al. |
| 8,096,960 | B2 | 1/2012 | Loree et al. |
| 8,179,270 | B2 | 5/2012 | Rai et al. |
| 8,191,187 | B2 | 6/2012 | Brykalski et al. |
| 8,290,596 | B2 | 10/2012 | Wei et al. |
| 8,348,840 | B2 | 1/2013 | Heit et al. |
| 8,418,285 | B2 | 4/2013 | Frias |
| 8,529,457 | B2 | 9/2013 | Devot et al. |
| 8,617,044 | B2 | 12/2013 | Pelgrim et al. |
| 8,768,520 | B2 | 7/2014 | Oexman et al. |
| 9,196,479 | B1 | 11/2015 | Cheng et al. |
| 9,402,763 | B2 | 8/2016 | Bledsoe |
| 10,391,009 | B2 | 8/2019 | Bhai |
| 10,923,226 | B2 | 2/2021 | Macary et al. |
| 10,959,667 | B2 | 3/2021 | Xin et al. |
| 2002/0014951 | A1 | 2/2002 | Kramer et al. |
| 2002/0080035 | A1 | 6/2002 | Youdenko |
| 2002/0124574 | A1 | 9/2002 | Guttman et al. |
| 2004/0049132 | A1 | 3/2004 | Barron et al. |
| 2005/0143617 | A1 | 6/2005 | Auphan |
| 2005/0154330 | A1 | 7/2005 | Loree |
| 2006/0137099 | A1 | 6/2006 | Feher |
| 2006/0293602 | A1 | 12/2006 | Clark |
| 2006/0293608 | A1 | 12/2006 | Rothman et al. |
| 2008/0016881 | A1 | 1/2008 | Steffensen et al. |
| 2008/0234785 | A1 | 9/2008 | Nakayama et al. |
| 2009/0154103 | A1* | 6/2009 | Liu ..... H01L 23/467 361/709 |
| 2009/0288800 | A1 | 11/2009 | Kang et al. |
| 2010/0011502 | A1 | 1/2010 | Brykalski et al. |
| 2010/0100004 | A1 | 4/2010 | Someren |
| 2010/0199687 | A1 | 8/2010 | Woods et al. |
| 2010/0324611 | A1 | 12/2010 | Deming et al. |
| 2011/0015495 | A1 | 1/2011 | Dothie et al. |
| 2011/0073292 | A1 | 3/2011 | Datta et al. |
| 2011/0107514 | A1 | 5/2011 | Brykalski et al. |
| 2011/0153274 | A1 | 6/2011 | Ho et al. |
| 2011/0181597 | A1 | 7/2011 | Cardno et al. |
| 2011/0230790 | A1 | 9/2011 | Kozlov |
| 2011/0252461 | A1 | 10/2011 | Wetzer et al. |
| 2011/0267196 | A1 | 11/2011 | Hu et al. |
| 2012/0054754 | A1 | 3/2012 | Teichmann et al. |
| 2012/0136666 | A1 | 5/2012 | Corpier et al. |
| 2012/0159968 | A1 | 6/2012 | Doucet et al. |
| 2013/0019611 | A1 | 1/2013 | Sims et al. |
| 2013/0060306 | A1 | 3/2013 | Colbauch |
| 2013/0208576 | A1 | 8/2013 | Loree, IV et al. |
| 2013/0234823 | A1 | 9/2013 | Kahn et al. |
| 2013/0304768 | A1 | 11/2013 | Basnight et al. |
| 2014/0006001 | A1 | 1/2014 | Kamhi et al. |
| 2014/0208508 | A1 | 7/2014 | Mikesell |
| 2014/0316495 | A1 | 10/2014 | Augustine et al. |
| 2015/0093101 | A1 | 4/2015 | Lee |
| 2015/0203068 | A1 | 7/2015 | Foo et al. |
| 2015/0351982 | A1 | 12/2015 | Krenik |
| 2015/0366703 | A1 | 12/2015 | Du |
| 2016/0015184 | A1 | 1/2016 | Nunn et al. |
| 2016/0029808 | A1 | 2/2016 | Youngblood et al. |
| 2016/0136385 | A1 | 5/2016 | Scorcioni |
| 2016/0151603 | A1 | 6/2016 | Shouldice et al. |
| 2016/0239624 | A1 | 8/2016 | Short et al. |
| 2016/0249842 | A1 | 9/2016 | Lubelchick |
| 2016/0310697 | A1 | 10/2016 | Franceschetti et al. |
| 2017/0053068 | A1 | 2/2017 | Pillai et al. |
| 2019/0099009 | A1 | 4/2019 | Connor |
| 2019/0209405 | A1 | 7/2019 | Sayadi et al. |
| 2019/0231081 | A1 | 8/2019 | Youngblood et al. |
| 2020/0100682 | A1 | 4/2020 | Abreu et al. |
| 2020/0236907 | A1 | 7/2020 | Nilsson et al. |
| 2020/0337470 | A1 | 10/2020 | Sayadi et al. |
| 2020/0397379 | A1 | 12/2020 | Franceschetti et al. |

OTHER PUBLICATIONS

Quan, S. F. et. al; "Healthy Sleep the Characteristics of Sleep" (Sep. 21, 2016) pp. 1-4, retrieved from http://healthysleep.med.harvard.edu/healthy/science/what/characteristics.

Tobaldini, E. et. al; "Heart rate variability in normal and pathological sleep", Frontiers in Physiology, (Oct. 16, 2013), p. 1-11, vol. 4, Article 294, doi: 10.3389/fphys.2013.00294.

U.S. Appl. No. 61/800,768 Youngblood,Thermo electric heating and cooling device, filed Mar. 15, 2013, Drawings and Specification.

U.S. Appl. No. 62/398,257, Youngblood,Bed Pad With Custom Modulated Temperature Adjustment, filed Sep. 22, 2016, Drawings and Specification.

* cited by examiner

ARTICLE COMPRISING A TEMPERATURE-CONDITIONED SURFACE, THERMOELECTRIC CONTROL UNIT, AND METHOD FOR TEMPERATURE-CONDITIONING THE SURFACE OF AN ARTICLE

CROSS REFERENCES TO RELATED APPLICATIONS

This application is related to and claims priority from the following US patent applications. This application is a continuation of U.S. patent application Ser. No. 16/383,092, filed Apr. 12, 2019, which is a continuation of U.S. patent application Ser. No. 14/777,050, filed Sep. 15, 2015 and issued as U.S. Pat. No. 10,278,511, which is a national stage entry of PCT Application No. PCT/US14/30202, filed Mar. 17, 2014, which claims the benefit of U.S. Provisional Patent Application No. 61/800,768, filed Mar. 15, 2013, each of which is incorporated herein by reference in its entirety.

1. FIELD OF THE INVENTION

This invention relates broadly and generally to an article comprising a temperature-conditioned surface, thermoelectric control unit, and method for temperature-conditioning the surface of an article.

2. SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a thermoelectric control unit adapted for regulating liquid temperature in a hydraulic circuit. The control unit comprises a housing, and a liquid reservoir for containing a liquid inside the housing. The reservoir has a fill opening, a liquid outlet, and a liquid return. A conduit assembly extends from the liquid outlet to the liquid return. A pump is operatively connected to the reservoir, and is adapted for moving the liquid through the conduit assembly within the hydraulic circuit. A first heat exchanger communicates with the liquid reservoir. A second heat exchanger resides adjacent the first heat exchanger, and communicates with a surrounding environment outside of the liquid reservoir and inside of the housing. A substantially planar thermoelectric cooling module is located at an electrified junction between the first and second heat exchangers. The cooling module has a first major surface facing the first heat exchanger, and a second major surface facing the second heat exchanger. The first major surface of the cooling module functions to cool the first heat exchanger through conduction, thereby cooling the liquid contained in the liquid reservoir. The second major surface of the cooling module generates heat which is transferred through conduction by the second heat exchanger to the environment outside of the reservoir.

According to another exemplary embodiment, the first heat exchanger comprises a metal heat sink having a planar base, and a plurality of spaced-apart planar fins extending perpendicularly outward from the base.

According to another exemplary embodiment, the planar base of the heat sink resides in direct thermal contact with the first major surface of the thermoelectric cooling module.

According to another exemplary embodiment, the fins of the heat sink extend inside the liquid reservoir, and are arranged to reside in direct thermal contact with the liquid contained in the reservoir.

According to another exemplary embodiment, the thermoelectric cooling module comprises a Peltier chip.

According to another exemplary embodiment, the second heat exchanger comprises a metal heat sink having a planar base, and a plurality of spaced-apart planar fins extending perpendicularly outward from the base.

According to another exemplary embodiment, the planar base of the second heat sink resides in direct thermal contact with the second major surface of the thermoelectric cooling module.

According to another exemplary embodiment, the fins of the second heat sink extend away from the liquid reservoir, and are arranged to reside in direct thermal contact with the environment outside of the liquid reservoir and inside of the housing.

According to another exemplary embodiment, an electric case fan is mounted inside the housing, and is adapted for moving air across the second heat sink.

According to another exemplary embodiment, a linear heat tube is located outside of the reservoir and inside the housing, and communicates with the conduit assembly to selectively heat liquid moving within the hydraulic circuit.

According to another exemplary embodiment, the conduit assembly comprises flexible (e.g., silicone) tubing extending outside of the housing to a remote temperature-conditioned article; the flexible tubing moving the liquid through the temperature-conditioned article and forming a portion of the hydraulic circuit. The term "remote" means that the article physically distant from the control unit, although interconnected by flexible tubing or the like.

In another exemplary embodiment, the present disclosure comprises the combination of a temperature-conditioned article (e.g., flexible cover) and a thermoelectric control unit. The exemplary control unit, as described herein, is adapted for adjusting liquid temperature within a hydraulic circuit running through the article.

The term "flexible cover" is defined broadly herein to mean any pad, cover, cushion, pillow, blanket, wrap, or the like. According to one exemplary embodiment, the flexible cover comprises a fabric mattress pad.

In yet another exemplary embodiment, the present disclosure comprises a method for temperature-conditioning a flexible cover. The method includes simultaneously cooling a liquid contained in a reservoir of a thermoelectric temperature control unit, and transferring heat to an environment outside of the reservoir and inside of the control unit. The cooled liquid is pumped from the reservoir within a hydraulic circuit passing from the control unit through flexible tubing inside the cover and back to the control unit.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
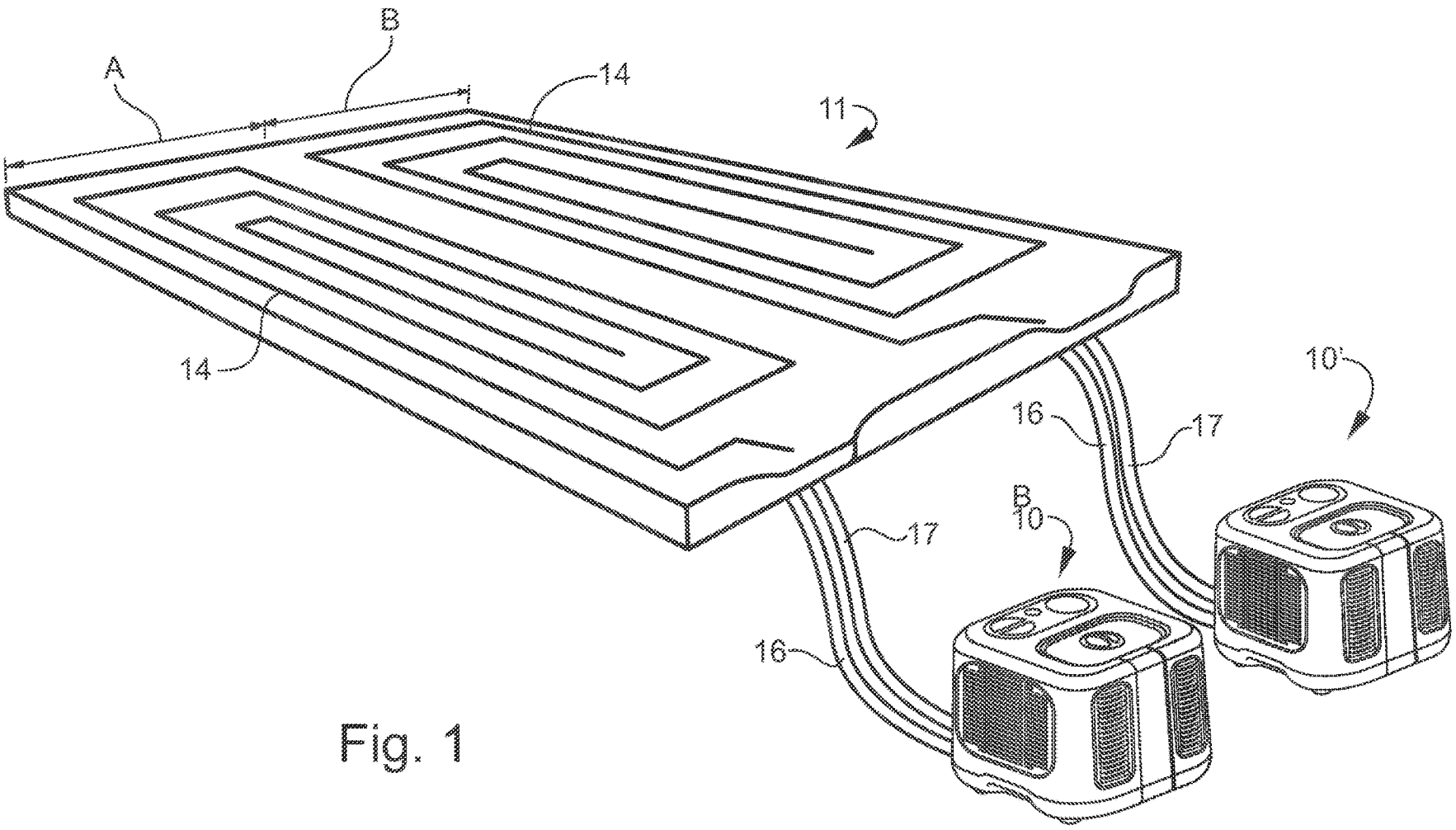
FIG. 1 is an environmental perspective view of a temperature-regulated mattress pad having two surface temperature zones connected to respective thermoelectric control units according to one exemplary embodiment of the present disclosure.
Figure 2:
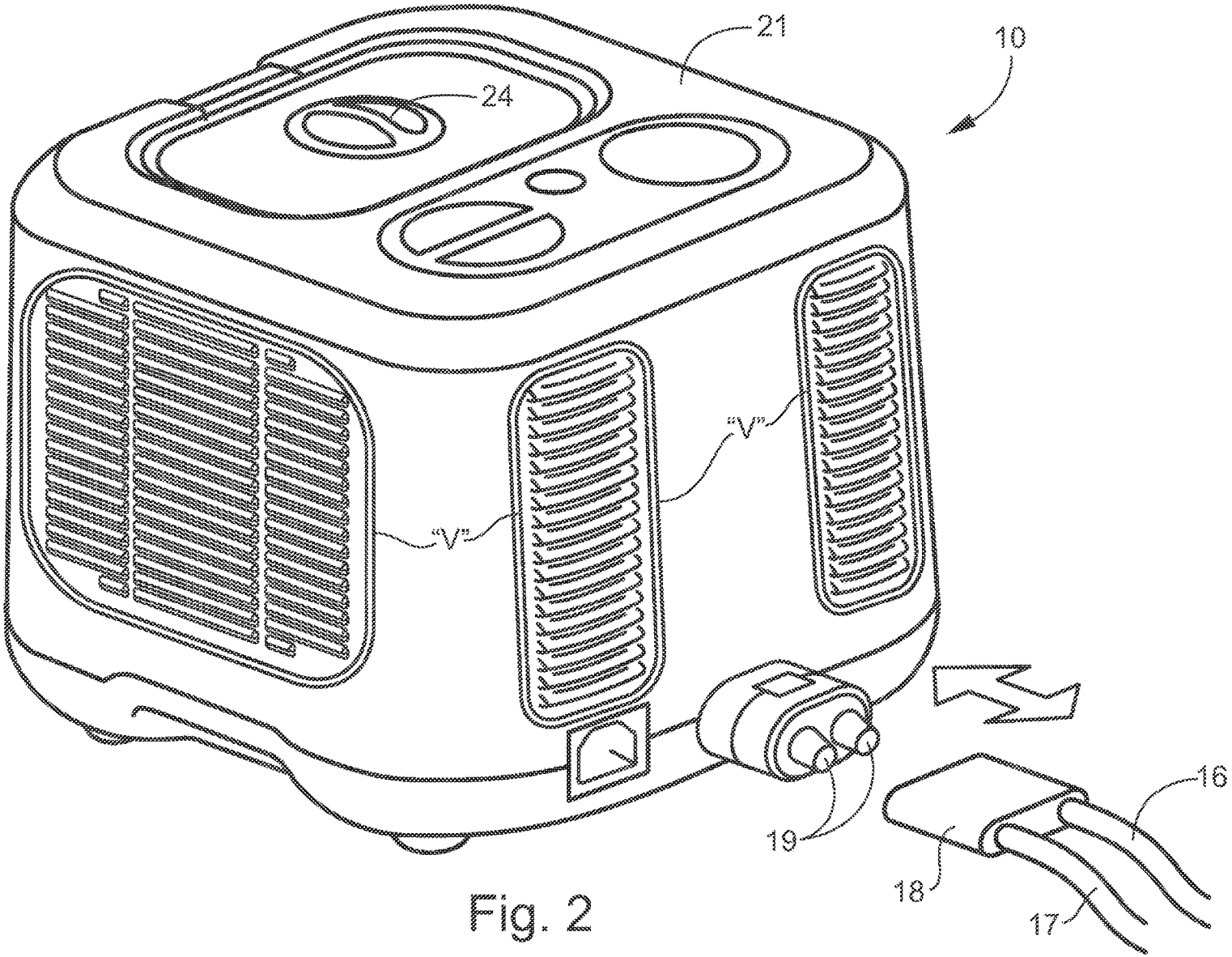
FIG. 2 is a perspective view of the exemplary control unit demonstrating the quick connection/disconnection of the flexible water supply and return lines.

Referring now specifically to the drawings, a thermoelectric control unit according to one exemplary embodiment of the present disclosure is illustrated in FIG. 1, and shown generally at broad reference numeral 10. In the exemplary implementation shown, a pair of identical control units 10, 10' attach through flexible conduit to a temperature-conditioned article, such as mattress pad 11. The mattress pad 11 has two independent thermally regulated surface zones "A" and "B"—each comprising internal flexible (e.g., silicone) tubing 14 designed for circulating heated or cooled liquid within a hydraulic circuit between the control unit 10 and mattress pad 11. As best shown in FIGS. 1 and 2, the flexible conduit assembly for each control unit 10 comprises separate liquid supply and return lines 16, 17 fluidly connected to tubing 14, and a quick-release female connector 18 for ready attachment and detachment to external male connectors 19 of the control unit 10. In alternative exemplary embodiments, the thermoelectric control unit 10 may be operatively connected (e.g., by flexible conduit) to any other temperature-regulated article, such as a blanket or other bedding or covers, seat pad, sofa, chair, mattress, or the like.

Figure 3:
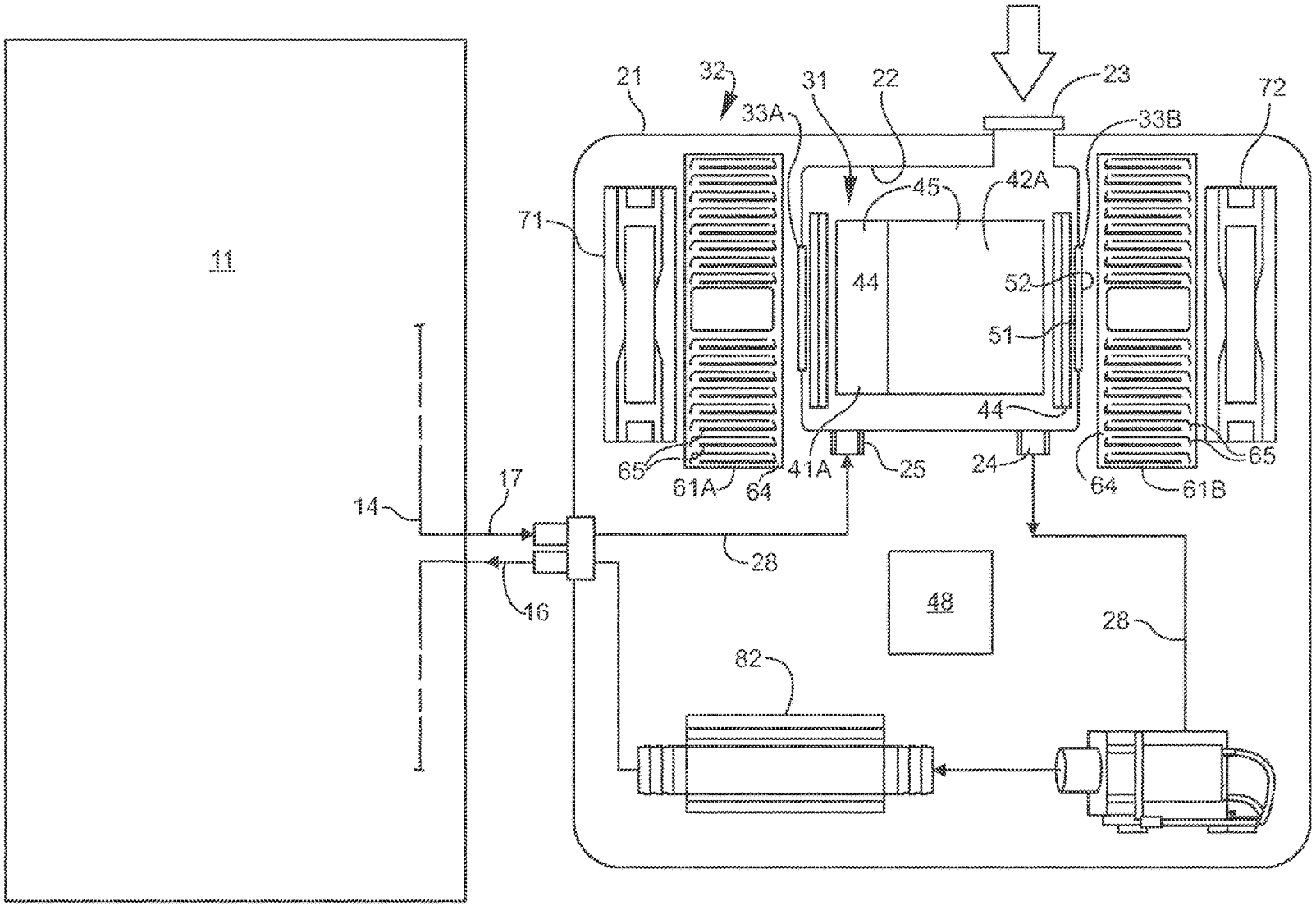
FIG. 3 is a side schematic view showing various internal components of the exemplary control unit fluidly connected to the mattress pad.
Figure 4:
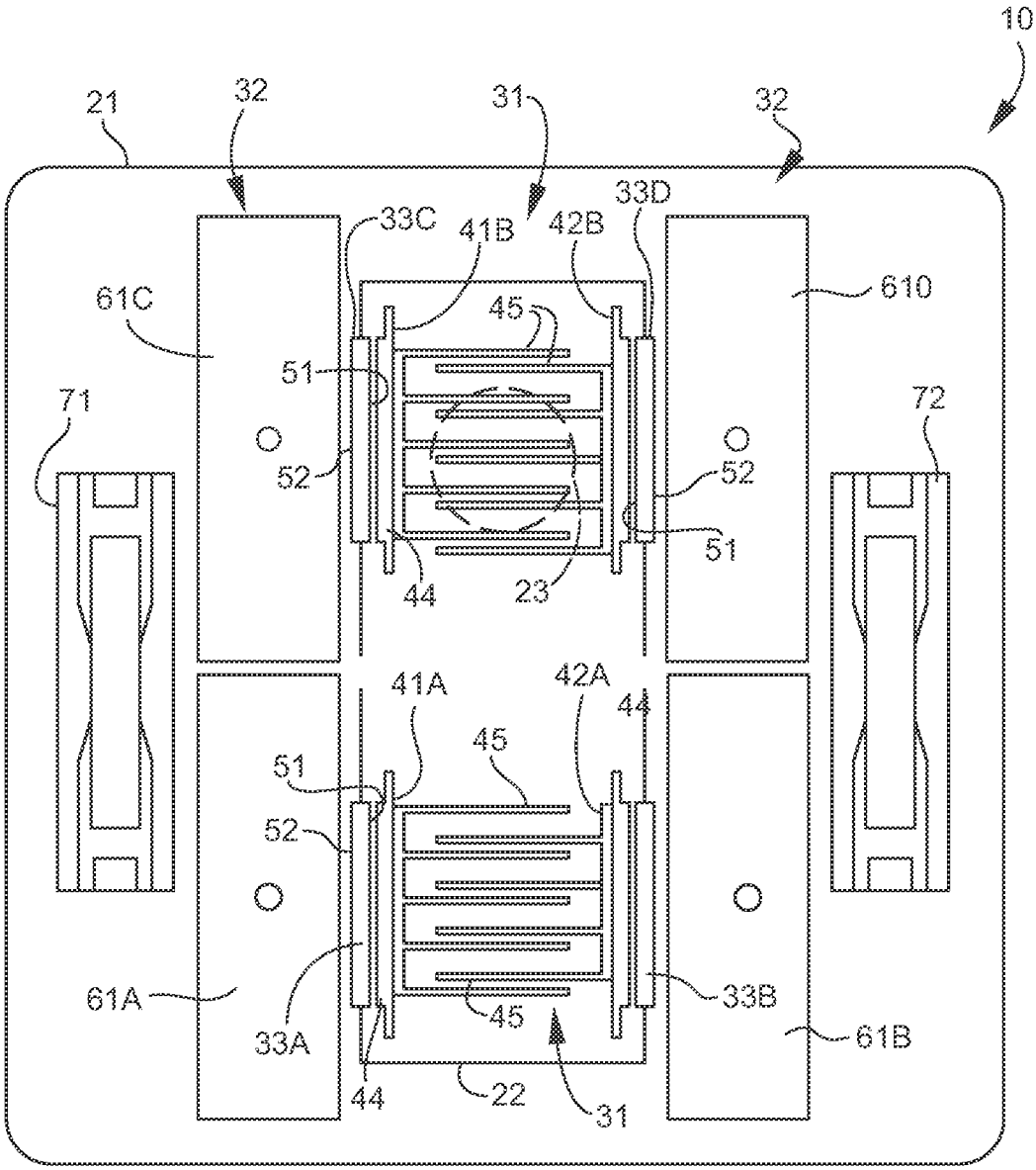
FIG. 4 is a top schematic view of the exemplary control unit.

As illustrated schematically FIGS. 3 and 4, the exemplary control unit 10 comprises an external cube-shaped housing 21, and a liquid reservoir 22 located inside the housing 21. The reservoir 22 has a fill opening 23 accessible through a removably capped opening 24 (FIG. 2) in housing 21, a water outlet 24, and a water return 25. Water contained in the reservoir 22 is moved in a circuit through a conduit assembly comprising in-housing tubes 28, the flexible supply and return lines 16, 17, and flexible silicone tubing 14 within the temperature-regulated pad 11. The water is selectively cooled, as described further below, by cooperating first and second heat exchangers 31, 32 and thermoelectric cooling modules 33A-33D. The cooling modules 33A-33D reside at an electrified junction between the first and second heat exchangers 31, 32, and function to regulate water temperature from a cool point of as low 46 degrees F., or cooler. The housing 21 and reservoir 22 may be either separately or integrally constructed of any suitable material, such as an anti-flammable ABS, polypropylene, or other molded polymer.

Referring to FIGS. 3 and 4, the first heat exchanger 31 comprises pairs of oppositely directed internal heat sinks 41A, 42A and 41B, 42B communicating with an inside of the reservoir 22, and cooperating with thermoelectric cooling modules 33A-33D to cool the water inside the reservoir 22 to a selected (set) temperature. Each heat sink 41A, 42A, 41B, 42B has a substantially planar metal base 44 adjacent an exterior side wall of the reservoir 22, and a plurality of planar metal fins 45 extending substantially perpendicular to the base 44 and vertically inward towards a center region of the reservoir 22. In the exemplary embodiment, each pair of heat sinks 41A, 42A and 41B, 42B comprises one 4-fin sink and one 5-fin sink arranged such that their respective fins 45 are facing and interleaved as shown in FIG. 4. The exemplary cooling modules 33A-33D are operatively connected to an internal power supply/main control board 48, and comprise respective thin Peltier chips having opposing planar inside and outside major surfaces 51, 52. The inside major surface 51 of each cooling module 33A-33D resides in direct thermal contact with the planar base 44 of its corresponding heat sink 41A, 42A, 41B, 42B. A thermal pad or compound (not shown) may also reside between each cooling module 33A-33D and heat sink 41A, 42A, 41B, 42B to promote thermal conduction from base 44 outwardly across the fins 45.

The second heat exchanger 32 comprises external heat sinks 61A-61D located outside of the water reservoir 22, and arranged in an opposite-facing direction to respective internal heat sinks 41A, 42A, 41B, 42B. Each external heat sink 61A-61D has a planar metal base 64 in direct thermal contact with the outside major surface 52 of an associated adjacent cooling module 33A-33D, and a plurality of planar metal fins 65 extending substantially perpendicular to the base 64 and horizontally outward away from the water reservoir 22. Heat generated by the cooling modules 33A-33D is conducted by the external heat sinks 61A-61D away from the modules 33A-33D and dissipated to a surrounding environment outside of the water reservoir 22. Electric case fans 71 and 72 may be operatively connected to the power supply/main control board 48 and mounted inside the housing 21 adjacent respective heat sinks 61A, 61B and 61C, 61D. The exemplary fans 71, 72 promote air flow across the sink fins 65, and outwardly from the control unit 10 through exhaust vents "V" formed with the sides and bottom of the housing 21. In one embodiment, each external heat sink 61A-61D has a substantially larger base 64 (as compared to the 4-fin and 5-fin internal sinks 41A, 42A, 41B, 42B) and a substantially greater number of fins 65—e.g., 32 or more. Both internal and external heat sinks may be active or passive, and may be constructed of any suitable conductive material, including aluminum, copper, and other metals. The heat sinks may have a thermal conductivity of 400 watts per Kelvin per meter (W/mK), or more. The case fans 71, 72 may automatically activate and shuts off as needed.

From the reservoir 22, the temperature conditioned water exits through the outlet 24 and enters the conduit assembly comprising an arrangement of in-housing Z-, L-, 7-, and S-shaped tubes 28 (and joints). A pump 81 is operatively connected to the reservoir 22 and functions to circulate the water through the control unit 10 in a circuit including the in-housing tubes 28 (and joints), flexible water supply line 16, silicone pad tubes 14, water return line 17, and back into the reservoir 22 through water return 25. As shown in FIG. 3, an insulated linear heat tube 82 is located outside of the water reservoir 22 and inside the housing 21, and communicates with the conduit assembly to selectively heat water moving from the control unit 10 to the mattress pad 11. The exemplary heat tube 82 may heat water moving in the hydraulic circuit to a desired temperature of as warm as 118 degrees F.

The exemplary thermoelectric control unit 10 may further comprise other features and electronics not shown including a touch control and display board, overheat protectors, water level sensor, thermostat, additional case fans, and other such components. The control unit 10 may also comprise an external power cord designed to plug into standard household electrical outlets.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed is:

1. A control unit for regulating fluid temperature in a hydraulic circuit, comprising:

a housing;

a liquid reservoir for containing a liquid inside the housing, and comprising a liquid outlet and a liquid return;

a conduit assembly extending from the liquid outlet to the liquid return;

at least one pump adapted for moving the liquid through the conduit assembly within the hydraulic circuit;

a heat exchanger in communication with the liquid reservoir, wherein the heat exchanger includes a first heat sink and a second heat sink, wherein the first heat sink includes a first plurality of fins and the second heat sink includes a second plurality of fins;

a first cooling module located adjacent to the first heat sink; and a second cooling module located adjacent to the second heat sink; and a second heat exchanger, wherein the second heat exchanger includes a first external heat sink including a first plurality of external fins and a second external heat sink including a second plurality of external fins;

wherein the first plurality of fins extends from the first heat sink into the liquid reservoir;

wherein the second plurality of fins extends from the second heat sink into the liquid reservoir;

wherein the first cooling module functions to cool the first heat sink and wherein the second cooling module functions to cool the second heat sink, and wherein the first plurality of fins extends towards the second plurality of fins.

2. The control unit of claim 1, wherein the first plurality of external fins and the second plurality of external fins extend away from the liquid reservoir.

3. The control unit of claim 1, wherein a number of the first plurality of external fins is greater than a number than of the first plurality of fins and wherein a number of the second plurality of external fins is greater than a number than of the second plurality of fins.

4. The control unit of claim 1, wherein the first cooling module is located at a junction between the first heat sink and the first external heat sink and wherein the second cooling module is located at a junction between the second heat sink and the second external heat sink.

5. The control unit of claim 1, wherein the first external heat sink is in thermal contact with the first cooling module and wherein the second external heat sink is in thermal contact with the second cooling module.

6. The control unit of claim 1, wherein the conduit assembly comprises tubing extending from the liquid outlet downwards to the at least one pump, tubing extending from the at least one pump to at least one heat tube, tubing extending from the at least one heat tube to an external connector of the control unit, tubing extending from the external connector of the control unit to the liquid return, and tubing extending from a connector of a temperature-conditioned article throughout the temperature-conditioned article and back to the connector of the temperature-conditioned article.

7. The control unit of claim 1, wherein the first heat sink is metal and wherein the second heat sink is metal.

8. The control unit of claim 1, wherein the first plurality of fins is a plurality of spaced-apart planar fins extending perpendicularly outward from the first heat sink, and wherein the second plurality of fins is a plurality of spaced-apart planar fins extending perpendicularly outward from the second heat sink.

9. The control unit of claim 1, further comprising at least one fan adapted for moving air away from the control unit.

10. The control unit of claim 1, wherein the liquid reservoir and the housing are constructed of anti-flammable Acrylonitrile Butadiene Styrene (ABS) or polypropylene.

11. The control unit of claim 1, further comprising a linear heat tube located outside of the reservoir and inside the housing, wherein the linear heat tube is in communication with the conduit assembly to heat liquid moving within the hydraulic circuit.

12. The control unit of claim 1, wherein a base of the first heat sink is planar, and wherein a base of the second heat sink is planar.

13. The control unit of claim 1, wherein the first cooling module and/or the second cooling module comprises a Peltier chip.

14. The control unit of claim 1, wherein the conduit assembly is formed from a material comprising silicone.

15. A control unit for regulating fluid temperature in a hydraulic circuit, comprising:

a housing;

a liquid reservoir for containing a liquid inside the housing, and comprising a liquid outlet and a liquid return;

a conduit assembly extending from the liquid outlet to the liquid return;

at least one pump adapted for moving the liquid through the conduit assembly within the hydraulic circuit;

a heat exchanger in communication with the liquid reservoir, wherein the heat exchanger includes a first internal heat sink and a second internal heat sink, wherein the first internal heat sink includes a first plurality of internal fins and the second internal heat sink includes a second plurality of internal fins; a second heat exchanger, wherein the second heat exchanger includes a first external heat sink including a first plurality of external fins and a second external heat sink including a second plurality of external fins;

a first cooling module located at a junction between the first internal heat sink and the first external heat sink; and a second cooling module located at a junction between the second internal heat sink and the second external heat sink;

wherein the first plurality of internal fins extends from the first internal heat sink; and wherein the second plurality of internal fins extends from the second internal heat sink.

16. The control unit of claim 15, wherein the first plurality of external fins and the second plurality of external fins extend away from the liquid reservoir.

17. The control unit of claim 15, wherein a number of the first plurality of external fins is greater than a number than of the first plurality of internal fins and wherein a number of the second plurality of external fins is greater than a number than of the second plurality of internal fins.

18. A control unit for regulating fluid temperature in a hydraulic circuit, comprising:

a housing;

a liquid reservoir for containing a liquid inside the housing, and comprising a liquid outlet and a liquid return;

a conduit assembly extending from the liquid outlet to the liquid return;

at least one pump adapted for moving the liquid through the conduit assembly within the hydraulic circuit;

a heat exchanger in communication with the liquid reservoir, wherein the heat exchanger includes a first heat sink and a second heat sink, wherein the first heat sink includes a first plurality of fins and the second heat sink includes a second plurality of fins; and a first cooling module located adjacent to the first heat sink and a second cooling module located adjacent to the second heat sink; and a second heat exchanger, wherein the second heat exchanger includes a first external heat sink including a first plurality of external fins and a second external heat sink including a second plurality of external fins, and wherein the first plurality of external fins and the second plurality of external fins extend away from the liquid reservoir;

wherein the first plurality of fins is a plurality of spaced-apart planar fins extending perpendicularly outward from the first heat sink, and wherein the second plurality of fins is a plurality of spaced-apart planar fins extending perpendicularly outward from the second heat sink;

wherein the first plurality of fins extends towards the second plurality of fins; and wherein the conduit assembly comprises tubing extending from the liquid outlet to the at least one pump, tubing extending from the at least one pump to at least one heat tube, tubing extending from the at least one heat tube to an external connector of the control unit, tubing extending from the external connector of the control unit to the liquid return, and tubing extending from a connector of a temperature-conditioned article throughout the temperature-conditioned article and back to the connector of the temperature-conditioned article.

* * * * *